United States Patent [19]

Podolak

[11] 4,253,662

[45] Mar. 3, 1981

[54] ACCESSORY APPARATUS FOR WEIGHT LIFTING

[76] Inventor: Wayne S. Podolak, 111 Kincaid Ave., Syracuse, N.Y. 13204

[21] Appl. No.: 9,103

[22] Filed: Feb. 5, 1979

[51] Int. Cl.[3] ..... A63B 13/00

[52] U.S. Cl. ..... 272/123; 272/144; 272/143

[58] Field of Search ..... 272/117, 123, 118, 134, 272/144, DIG. 4, 61; 214/86 R, 88; 212/11, 98, 134, 143; 294/82 R

[56] References Cited

U.S. PATENT DOCUMENTS

| | | | |
|---|---|---|---|
| 1,481,868 | 11/1924 | Huckins | 212/98 |
| 2,520,238 | 8/1950 | Culp | 212/134 |
| 2,600,887 | 6/1952 | Lannen | 414/909 X |
| 2,631,582 | 3/1953 | Bensfield | 128/25 R |
| 3,683,898 | 8/1972 | Underwood | 128/25 R |
| 3,894,534 | 7/1975 | Graves et al. | 128/25 R |

*Primary Examiner*—William R. Browne
*Attorney, Agent, or Firm*—Bruns & Jenney

[57] ABSTRACT

Accessory apparatus for use by a person working with weights in a body building program. Under a modern, well accepted theory muscle growth and strength can best be promoted by "high intensity" exercise which means the repetitive performance of a resistance movement to the point of momentary muscular failure. In performing a high intensity exercise, as for example in bench pressing, the exerciser may find himself trapped beneath a heavy weight upon reaching the point of muscular failure. In such case, the apparatus of the invention eliminates the need for a human partner by providing power driven mechanical device for lifting the weight, said mechanical device being put into operation by a hand or foot operated switch easily accessible to the exerciser.

8 Claims, 7 Drawing Figures

ACCESSORY APPARATUS FOR WEIGHT LIFTING

Background of the Invention

This invention relates generally to athletic and exercise equipment, and has particular reference to novel accessory apparatus for use by a person working with weights in a body building program.

Under a modern, well accepted theory muscle growth can best be accomplished by high intensity exercise which means carrying out the repetitive performance of a resistance movement to the point of momentary muscular failure. The problem with this is that in an exercise such as bench pressing, for example, when muscular failure occurs the exerciser is quite likely to find himself trapped beneath a heavy weight that he can no longer move. This means that the exerciser-weight lifter must have a workout partner or "spotter" nearby to help him when assistance is needed.

The need for a workout partner generally means that the weight lifter cannot exercise at home even though he has the necessary equipment, and in the gym his exercise periods are restricted to finding a partner whose schedule coincides with his own. To the best of the applicant's knowledge, a mechanical substitute for a human workout partner has not been available heretofore.

SUMMARY OF THE INVENTION

The present invention provides an apparatus for mechanically assisting a weight lifter should assistance be needed, the actuation of the apparatus being effected by a hand or foot operated switch assessible to the user. The apparatus includes a standard having a base, an upstanding post and an elevated boom extending out from the post above the base. The weight lifter and his bench or other equipment are positioned adjacent the base of the standard beneath the end of the boom.

A chain extends down from the end of the boom and is operably connected to the weights being used. The chain engages a drive sprocket that is connected through a clutch to a motor. The clutch is normally disengaged but can be engaged by the weight lifter using a hand or foot operated switch. Engagement of the clutch causes the motor, operating through the drive sprocket and chain, to mechanically elevate the weights.

DESCRIPTION OF THE PREFERRED EMBODIMENT

Figure 1:
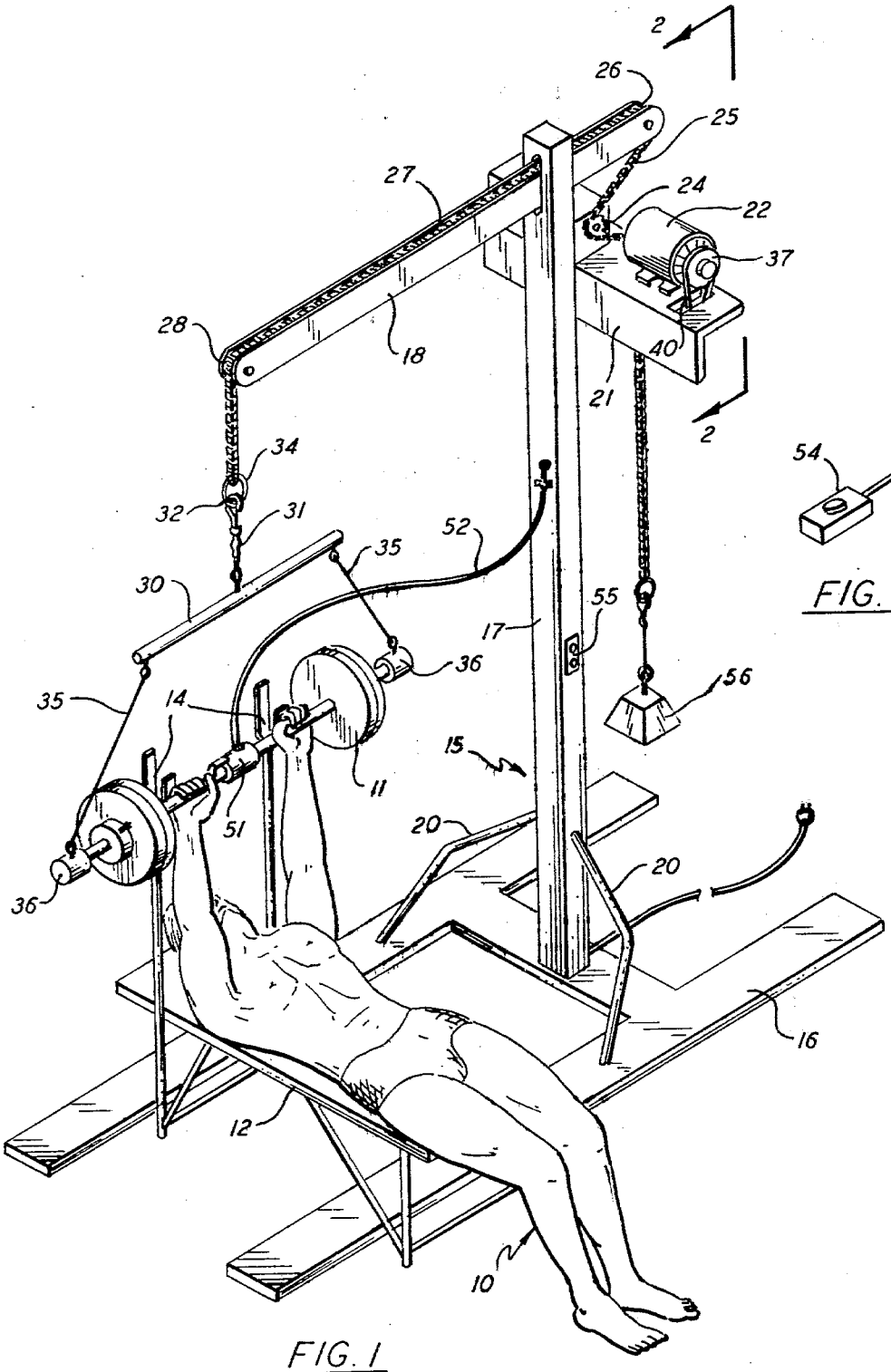
FIG. 1 is a perspective view of the apparatus of the invention showing the manner in which it can be used by a weight lifter.

Having reference now to the drawings, and with particular reference to FIG. 1, 10 indicates a user of the apparatus of the invention who is bench pressing a barbell 11 of conventional construction. The weight lifter is reclining on a conventional bench 12 having a power rack 14 for supporting the barbell when not in use.

The accessory apparatus includes a standard 15 comprising a generally H-shaped base 16, a post 17 extending vertically upwardly from the base and a horizontal boom 18 extending outwardly from the post above the base. In view of the weights that may be involved, the standard 15 is a welded steel construction with reinforcing members, such as rods 20, where necessary. In a preferred embodiment of the invention, the post 17 is 7–9 feet high and the boom 18 is 4–6 feet long.

Rigidly secured to the post 17 is a suitable shelf 21 which serves as a support for an electric motor 22 and a drive member in the form of a sprocket 24, the connection between the motor and sprocket to be described hereinafter. The sprocket engages a chain 25 that passes over a nylon roller 26 at the rear end of the boom and then extends along the top of the boom in a groove or channel 27 to another nylon roller 28 at the front end of the boom. From the roller 28 the chain extends downwardly for engagement with the barbell 11 or other weight arrangement that is being used by the weight lifter in the exercise.

In FIG. 1 the means for operably connecting the end of the chain 25 to the barbell includes a steel bar 30 having a linkage 31 at its mid-point that is connected by a snap hook 32 to a ring 34 secured to the end of the chain. The ends of bar 30 are respectively connected by cables 35 to cups 36, the cups engaging the ends of the barbell with a friction fit.

Figure 2:
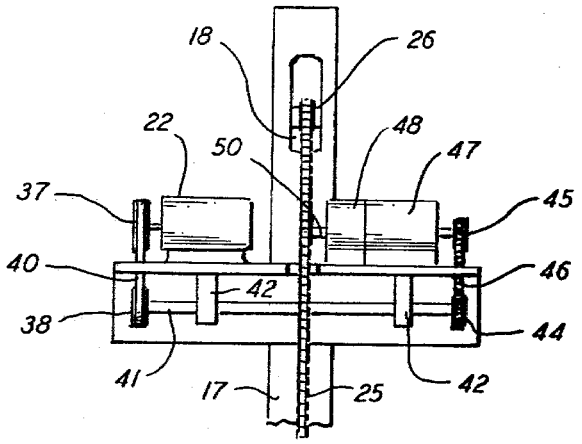
FIG. 2 is an elevation of the upper rear portion of the apparatus taken on line 2—2 of FIG. 1.

Referring now to FIGS. 1 and 2, the shaft of motor 22 is connected by pulleys 37, 38 and a belt 40 to a horizontal shaft 41 that is disposed beneath the shelf 21, the shaft being journalled in depending supports 42. At its opposite end, the shaft 41 is connected by pulleys 44, 45 and belt 46 to a suitable gear reduction box 47. The output shaft (not shown) of the gear reduction box is connected through a normally disengaged clutch mechanism 48 to a driven shaft 50 on which the previously mentioned drive sprocket 24 is mounted.

Figure 7:
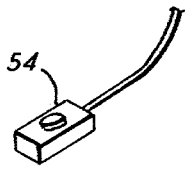
FIG. 7 is a perspective view of a foot operated clutch switch.

The clutch mechanism 48 can be any known type of friction or jaw clutch and a solenoid (not shown) is included in the mechanism for engaging and disengaging the clutch. The solenoid can be actuated by either a hand or foot operated switch. FIG. 1 illustrates a hand operated switch 51 connected by a cord 52 to the solenoid, the switch being adapted to be mounted on the bar of the barbell so that it can be operated by the weight lifter's thumb or finger. Alternatively, a foot operated switch 54, FIG. 7, can be employed.

In using the apparatus of the invention, the user first presses a switch 55 on the post 17 which starts motor 22 running. Since the clutch is normally disengaged, no power is delivered to the drive sprocket shaft 50 and the latter and the drive sprocket 24 simply idle or move freely with the chain 25 as the weight lifter moves the barbell 11 up and down. In this connection, it may be seen that the rear end of chain 25 extends below the shelf 21 and is connected to a relatively small weight 56 which serves to keep the chain taut at all times, particularly when the barbell is being elevated.

If the weight lifter reaches the point of momentary muscular failure and finds that he is essentially trapped by the barbell, he will operate either the hand or foot switch 51 or 54 which will actuate the solenoid and engage the clutch. This causes sprocket 24 to be positively driven by motor 22 in a counter clockwise direction as viewed in FIG. 1, and this will mechanically elevate the barbell until it can be guided into the power rack 14 at which time the weight lifter will again operate his switch to disengage the clutch.

Figure 3:
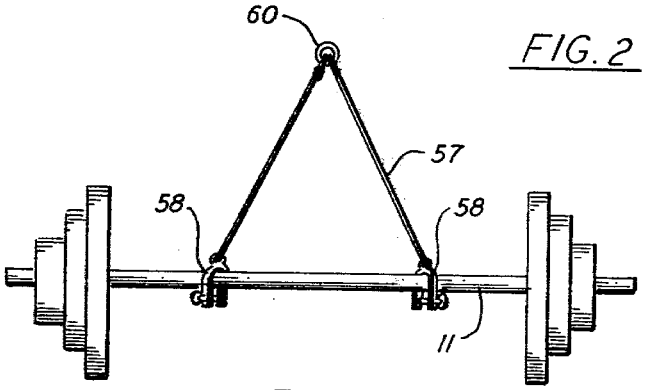
FIG. 3 is a front elevation of a barbell with one form of cable connector connected to it.
Figure 6:
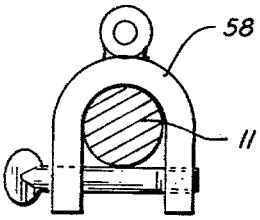
FIG. 6 is an enlarged detail of a cable connector fitting.
Figure 4:
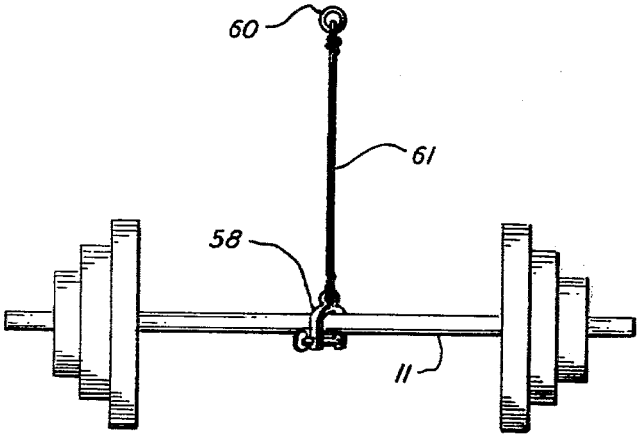
FIG. 4 is a view corresponding to FIG. 3, showing another form of cable connector.

FIGS. 3 and 4 illustrate alternative cable connectors for detachably connecting the chain 25 to a barbell or the like. In FIG. 3, the connector is a single cable 57 having a clevis type fitting 58, FIG. 6, at each end for engagement with the bar of the barbell. Between the fittings 58, the cable 57 carries a loose ring 60 which can be secured by any suitable fitting to the end of the chain. In FIG. 4, the connector is a single cable 61 having a clevis type fitting 58 at one end for engagement with the bar and a ring 60 at the other end for making the connection to the chain.

Figure 5:
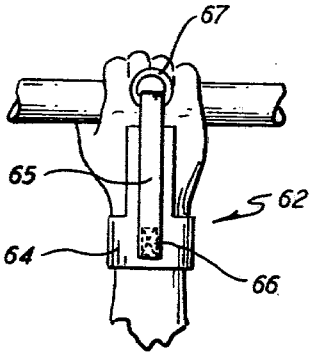
FIG. 5 is an elevation of a wrist attachment for use with a cable connector.

As an alternative to attaching the ends of a connector such as shown in FIG. 3 to the barbell, the connector ends can be attached to a fitting 62 as shown in FIG. 5 on each of the weight lifter's wrists. Each fitting 62 comprises a wrist encircling strap 64 of leather or strong, woven fabric and a woven strap 65 extending at right angles to the wrist strap to a point adjacent the user's knuckles. Strap 65 is secured at 66 to the wrist strap by sewing or riveting and at its other end has a ring 67 for attachment to an end of a cable such as cable 57 in FIG. 3.

From the foregoing description it will be apparent that the invention provides a novel and very advantageous apparatus for mechanically assisting a weight lifter should assistance be needed. As well be understood by those familiar with the art, the invention may be embodied in other specific forms without departing from the spirit or essential characteristics thereof.

I claim:

1. An apparatus for use in connection with a barbell that is being employed by a user for body building, the apparatus comprising a standard, a drive member supported by the standard and operably connected to the barbell, a power source, means operably connecting the power source to the drive member, said connecting means including normally disengaged clutch means, and means under control of the user for engaging the clutch means whereby the power source becomes operable to actuate the drive member and mechanically assist a user to raise the barbell during an exercise.

2. Apparatus as defined in claim 1 wherein the standard includes a boom an end of which is located above the position normally occupied by a user, the drive member being operably connected to the barbell by a flexible connecting member that extends along the boom and downward to the barbell.

3. Apparatus as defined in claim 2 wherein the drive member is a sprocket and the flexible connecting member is a chain.

4. Apparatus as defined in claim 3 together with a relatively small counterweight connected to the end of the chain opposite that connected to the barbell.

5. An apparatus for use in connection with a barbell that is being used by a weight lifter for body building; the apparatus including a standard having a base, a post extending upwardly from the base and a boom extending outwardly from the upper end of the post so as to be spaced a substantial distance above the base; a drive sprocket supported by the post; a chain in engagement with the drive sprocket and extending therefrom along said boom to the outer end thereof and from thence downwardly for connection to the barbell; a motor supported by the post; means operably connecting the motor to the drive sprocket, said last-named means including a normally disengaged clutch assembly; and means under control of the weight lifter for engaging the clutch means whereby the motor becomes operable to actuate the drive sprocket and mechanically assist a user to lift the barbell connected to the chain during an exercise.

6. Apparatus as defined in claim 5 wherein the means under control of the weight lifter is a hand operated switch.

7. Apparatus as defined in claim 5 wherein the means under control of the weight lifter is a foot operated switch.

8. Apparatus as defined in claim 5 together with a relatively small counterweight connected to the end of the chain opposite that connected to the arbell.

* * * * *